US010139782B2

(12) United States Patent
Saglini

(10) Patent No.: US 10,139,782 B2
(45) Date of Patent: Nov. 27, 2018

(54) TIMEPIECE MECHANISM FOR BIDIRECTIONAL CORRECTION OF A PLURALITY OF DISPLAYS

(71) Applicant: ETA SA Manufacture Horlogere Suisse, Grenchen (CH)

(72) Inventor: Julien Saglini, Bienne (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 15/812,010

(22) Filed: Nov. 14, 2017

(65) Prior Publication Data

US 2018/0157212 A1 Jun. 7, 2018

(30) Foreign Application Priority Data

Dec. 6, 2016 (EP) ..... 16202484

(51) Int. Cl.
*G04B 19/25* (2006.01)
*G04B 13/02* (2006.01)
*G04B 27/02* (2006.01)

(52) U.S. Cl.
CPC ..... *G04B 13/026* (2013.01); *G04B 19/25* (2013.01); *G04B 27/02* (2013.01)

(58) Field of Classification Search
CPC ..... G04B 13/026; G04B 27/02; G04B 19/25; G04B 13/021
See application file for complete search history.

(56) References Cited

U.S. PATENT DOCUMENTS 3,470,687 A * 10/1969 Noriyuki ..... G04B 19/25 368/32
3,597,916 A * 8/1971 Nakagawa ..... G04B 19/25 368/31

(Continued)

FOREIGN PATENT DOCUMENTS

CH 706 265 A2 9/2013
CH 706 265 B1 9/2013

(Continued)

OTHER PUBLICATIONS

European Search Report dated Jun. 12, 2017 in European Application 16202484.8, filed on Dec. 6, 2016 (with English Translation of Categories of Cited Documents).

*Primary Examiner* — Sean Kayes
(74) *Attorney, Agent, or Firm* — Oblon, McClelland, Maier & Neustadt, L.L.P.

(57) ABSTRACT

A bidirectional correction mechanism for correcting the position of a first and of a second gear train, via a setting device driving a corrector pinion, including a correction lever pivoting on an arbor of the corrector pinion, which carries, meshing with the corrector pinion, a first wheel set for driving the first gear train, and a second wheel set for driving the second gear train. This mechanism includes an elastic element which, in the absence of action on the setting device, returns the correction lever to a neutral position wherein the wheel sets are uncoupled from the first and second wheel trains, and either a friction connection between the correction lever and the arbor, or a friction connection between the elastic element on the one hand, and the first wheel set and the second wheel set on the other hand.

9 Claims, 3 Drawing Sheets

(56) References Cited

U.S. PATENT DOCUMENTS

| | | | | |
|---|---|---|---|---|
| 3,775,966 | A * | 12/1973 | Matsuura | G04B 19/25 368/32 |
| 3,798,893 | A * | 3/1974 | Ippoushi | G04B 19/25 368/32 |
| 6,295,249 | B1 | 9/2001 | Takahashi et al. | |
| 9,360,842 | B2 * | 6/2016 | Neboisa | G04B 27/026 |
| 2015/0331390 | A1 | 11/2015 | Gruenig | |
| 2015/0331392 | A1 * | 11/2015 | Ruefenacht | G04B 19/25 368/185 |
| 2016/0124388 | A1 * | 5/2016 | Neboisa | G04B 27/026 368/190 |

FOREIGN PATENT DOCUMENTS

| | | | |
|---|---|---|---|
| EP | 2 945 024 | A1 | 11/2015 |
| EP | 2 945 024 | B1 | 11/2015 |

* cited by examiner

TIMEPIECE MECHANISM FOR BIDIRECTIONAL CORRECTION OF A PLURALITY OF DISPLAYS

This application claims priority from European Patent Application No. 16202484.8 filed on Dec. 6, 2016, the entire disclosure of which is hereby incorporated herein by reference.

FIELD OF THE INVENTION

The invention concerns a bidirectional correction mechanism for correcting the position of at least a first gear train and a second gear train, and arranged to be controlled by the action of a user on a setting means, said mechanism comprising a corrector pinion, arranged to be controlled by said setting means, and including a correction lever that pivots coaxially to said corrector pinion on a main arbor comprised in said corrector pinion, and said correction lever carrying, meshing with said corrector pinion, a first intermediate wheel set arranged to drive said first gear train and a second intermediate wheel set arranged to drive said second gear train.

The invention also concerns a display mechanism including a plurality of displays controlled by such a timepiece control mechanism.

The invention also concerns a timepiece movement including such a display mechanism or such a timepiece correction mechanism.

The invention also concerns a watch including such a timepiece movement, or such a display mechanism, or such a timepiece correction mechanism.

The invention concerns the field of timepiece display mechanisms.

BACKGROUND OF THE INVENTION

In complicated timepieces, numerous functions have wheel sets held in position by jumper springs. The change of position often occurs when the date changes, and drive means must supply a substantial energy spike at that moment. Further, this time of the day is not conducive for performing corrections, which are not recommended, between 22:00 and midnight, in many mechanisms.

U.S. Pat. No. 6,295,249B1, in the name of SEIKO, discloses a correction device for a timepiece, comprising a setting wheel that can be controlled by rotating a winding stem. A lever has a rotational centre on an axis line coincident with an axis line of the rotational centre of the setting wheel, and is mounted to undergo a rocking movement in a first direction of rotation with respect to the movement, and in a second direction of rotation different from the first direction of rotation. The lever has a first portion extended in a first direction from the rotational centre, and a second portion extends in a second direction from the rotational centre. At least a first correction transfer wheel is disposed on the first portion of the lever to undergo a rotation as a function of the rotation of the setting wheel. At least a second correction transfer wheel is disposed on the second portion of the rocking bar to undergo a rotation as a function of the rotation of the setting wheel.

SUMMARY OF THE INVENTION

It is advantageous for energy consumption relating to the periodic driving of the display of certain time values to be spread over the day.

The invention proposes to develop a unique control mechanism, capable of managing several displays, with a simple and reliable system, comprising few components, and moreover lending itself to easy corrections at any time.

To this end, the invention concerns a timepiece mechanism for bidirectional correction of a plurality of displays, according to claim 1.

The invention also concerns a display mechanism comprising a plurality of displays controlled by such a timepiece correction mechanism.

The invention also concerns a timepiece movement including such a display mechanism or such a timepiece correction mechanism.

The invention also concerns a watch including such a timepiece movement, or such a display mechanism, or such a timepiece correction mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
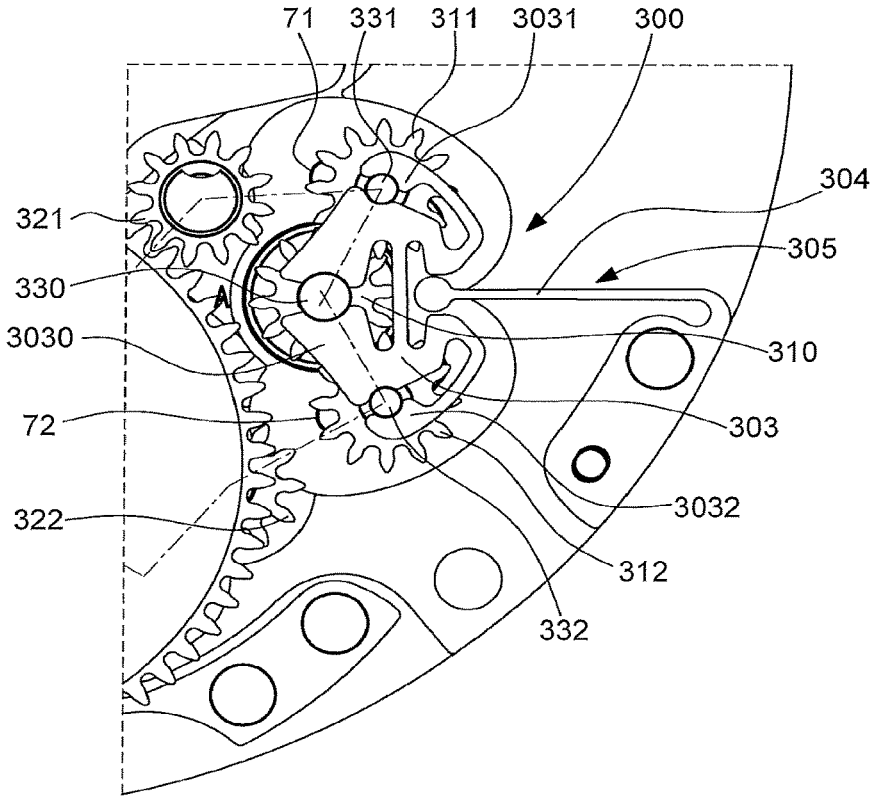
FIG. 1 represents a schematic, partial, plan view of a timepiece movement comprising a display mechanism with two distinct displays, whose input gear trains are disposed on either side of a rapid correction mechanism according to the invention, arranged to modify the positions of these two displays, and including a means for elastically returning a correction lever carrying sliding-gears to a neutral position, and including a single median spring.
Figure 2:
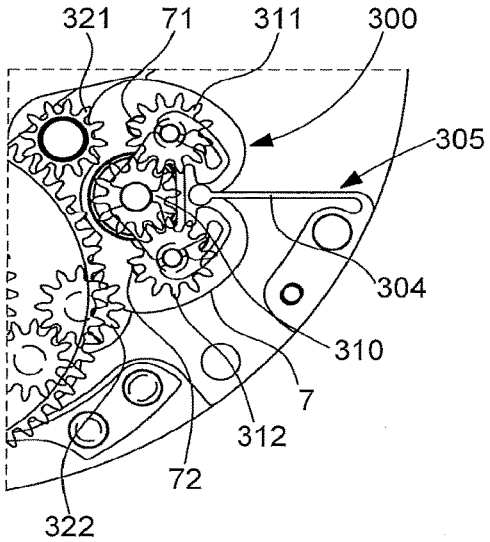
FIG. 2 is a similar view to that of FIG. 1 with the correction mechanism in a neutral position.
Figure 3:
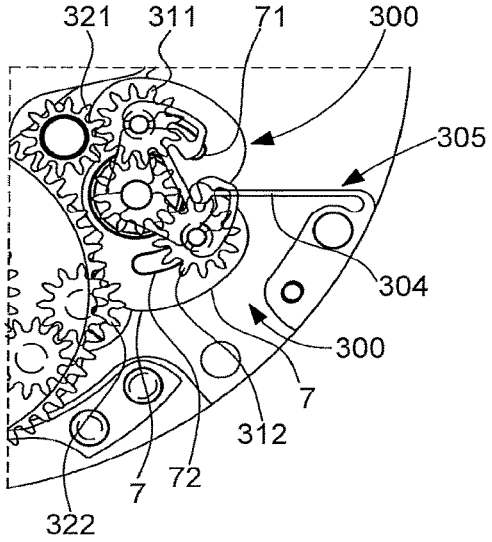
FIG. 3 is a similar view to FIG. 2, in a position for correcting a first gear train represented in the top part of the Figure.
Figure 4:
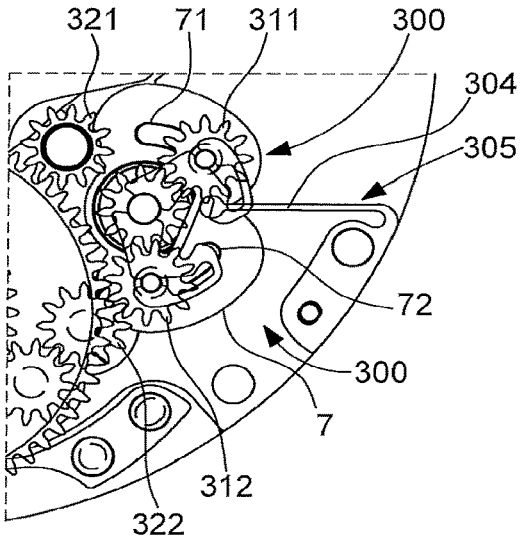
FIG. 4 is a similar view to FIG. 2, in a position for correcting a second gear train represented in the bottom part of the Figure.
Figure 5:
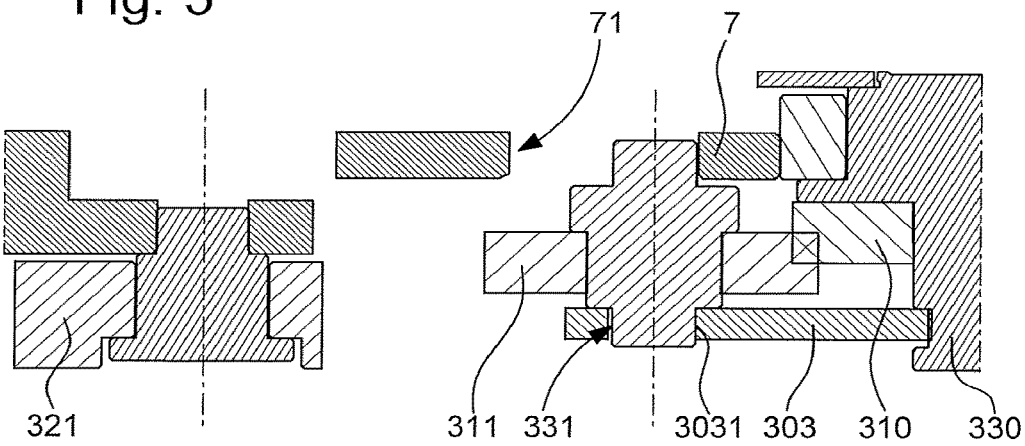
FIG. 5 represents the same mechanism, in a sectional view along the upper cutting-plane line of FIG. 1, detailing a first intermediate wheel set arranged to cooperate with the first gear train.
Figure 6:
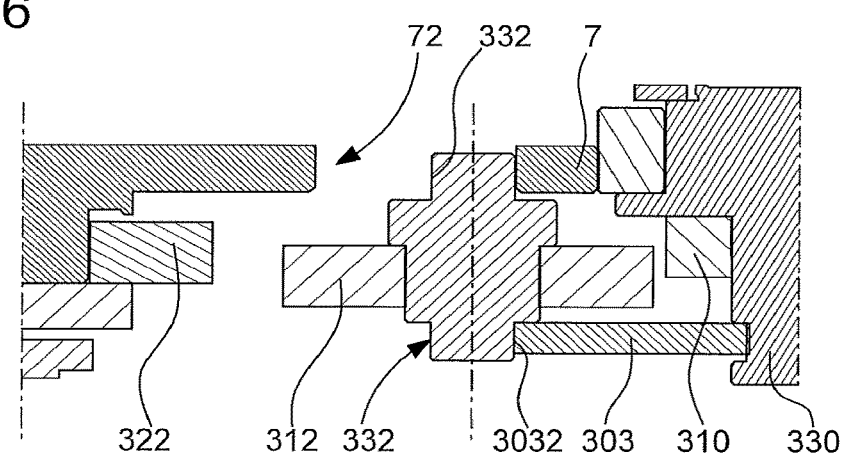
FIG. 6 represents the same mechanism, in a sectional view along the lower cutting-plane line of FIG. 1, detailing a second intermediate wheel set arranged to cooperate with the second gear train.

The invention concerns a bidirectional correction mechanism 300 for timepieces, which is arranged to be controlled by the action of a user on a setting means, such as a control stem or suchlike, acting on a corrector pinion 310, to rotate it in one direction or another.

This bidirectional correction mechanism 300 is arranged to correct the position of at least a first gear train 321 and a second gear train 322, and arranged to be controlled by the action of a user on such a setting means.

This mechanism 300 includes a corrector pinion 310, arranged to be controlled by said setting means, and including a correction lever 303 that pivots coaxially to corrector pinion 310 on a main arbor 330 comprised in corrector pinion 310.

This correction lever 303 carries, meshing with corrector pinion 310, a first intermediate wheel set 311, arranged to drive first gear train 321, and a second intermediate wheel set 312, arranged to drive second gear train 322.

According to the invention, this correction mechanism 300 includes at least one elastic element 305, which, in the absence of action by a user on the setting means, is arranged to return correction lever 303 to a neutral position in which first intermediate wheel set 311 is uncoupled from first gear train 321 and second intermediate wheel set 312 is uncoupled from second gear train 322. This bidirectional correction mechanism 300 includes at least, either a friction connection between correction lever 303 and main arbor 330 of corrector pinion 310, or a friction connection between elastic element 305, on the one hand, and first intermediate wheel set 311 and second intermediate wheel set 312 on the other hand.

More particularly, this bidirectional correction mechanism 300 includes both a friction connection between correction lever 303 and main arbor 330 of corrector pinion 310, and a friction connection between elastic element 305, on the one hand, and first intermediate wheel set 311 and second intermediate wheel set 312, on the other hand.

More particularly, this bidirectional correction mechanism 300 includes a friction connection between correction lever 303 and main arbor 330 of corrector pinion 310, and a friction connection between elastic element 305, on the one hand, and on the other hand, on a first side, a first arbor 331 of first intermediate wheel set 311, and on a second side, a second arbor 332 of second intermediate wheel set 312.

When first arbor 331 of first intermediate wheel set 311, or second arbor 332 of second intermediate wheel set 312 reaches a stop position, the corresponding friction connection slides, and the corresponding intermediate sliding gear wheel set 311, respectively 312, can then rotate freely, meshing with first gear train 321, respectively second gear train 322.

As a result of the friction, first intermediate wheel set 311 and second intermediate wheel set 312 rotate and move closer to or further away from their correction chain, depending on the direction of rotation imparted to correction lever 303. Indeed, bidirectional correction mechanism 300 includes a bar 7, comprising a first oblong hole 71 and a second oblong hole 72, in which are respectively guided first arbor 331 of first intermediate wheel set 311 and second arbor 332 of second intermediate wheel set 312, each intermediate wheel set 311, 312 being in a position of engagement with first gear train 321, respectively second gear train 322, when its arbor 331, 332 is stopped at the end of the oblong hole 71, 72 in which it moves. In this stopped position, the friction connection slide, and it is then possible to rotate intermediate moving sliding gear wheel set 311, 312 freely, and at any time.

The advantage of returning correction lever 303 to a neutral position in the absence of action on the setting means is that this limits friction, which would occur if the sliding gear remained in contact with a gear train. Another advantage is that the setting means is isolated, especially when it is formed by the control stem of a watch, to avoid inadvertent corrections.

Figure 7:
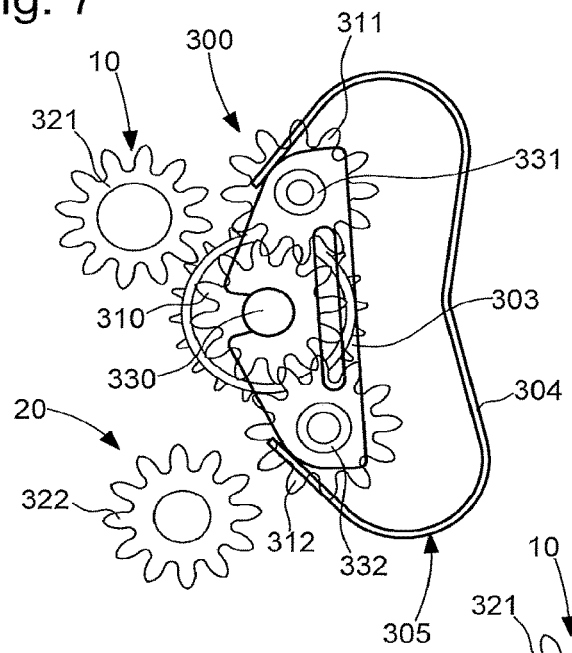
FIG. 7 is a similar view to FIG. 1, of a variant comprising a means of elastic return to a neutral position, surrounding the correction lever.

This friction connection between elastic element 315 and arbors 331 and 332 can be achieved directly, as represented in FIG. 7 where elastic element 305 is a spring 304 which rests on the edges of correction lever 303 in order to cause arbors 331 and 332 to rub on their housings in lever 303.

Figure 8:
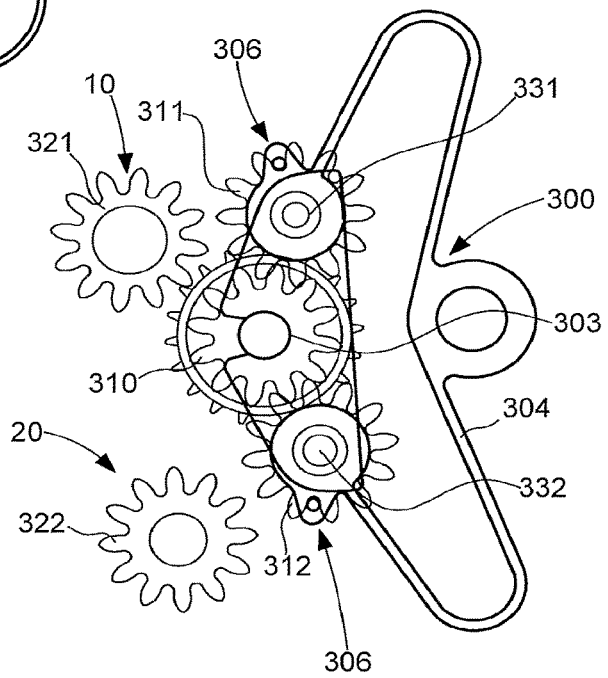
FIG. 8 is a similar view to FIG. 1, of another variant comprising a means of elastic return to a neutral position, which includes studs arranged to rub on the edges of the sliding pinion teeth.
Figure 9:
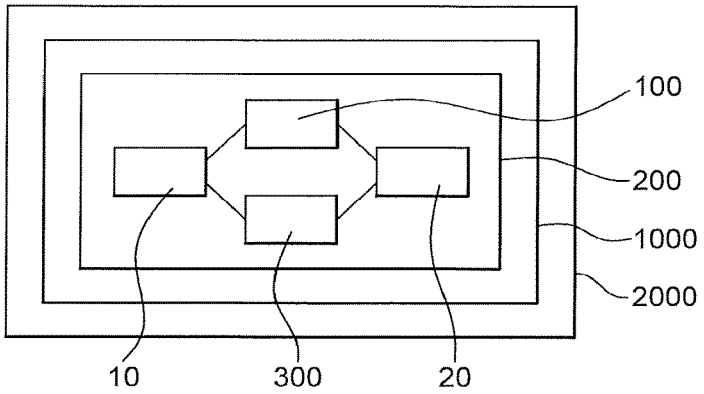
FIG. 9 is a block diagram representing a watch including such a timepiece movement with such a display mechanism, and such a timepiece mechanism for controlling two distinct displays, and such a mechanism for correcting these two displays.

The friction connection between elastic element and arbors 331 and 332 can advantageously be achieved directly, as represented in FIG. 1, where correction lever 303 forms clamps on each of the three arbors 330, 331 and 332, with friction jaws 3030, 3031, 3032, or as represented in the variant of FIG. 8, elastic element 305 is a spring 304, which has at the ends thereof blades carrying raised studs 306 arranged to rub directly against the edge of the teeth of first intermediate wheel set 311 and of second intermediate wheel set 312.

When the user ceases acting on the setting means, elastic element 305 returns first intermediate wheel set 311 and second intermediate wheel set 312 to the neutral position.

Such a bidirectional correction mechanism 300 is very thin, and in particular is no thicker than the moon phase or date display mechanism that it corrects. It can be made with a total thickness of 1.6 mm.

The invention also concerns a display mechanism 200 including a plurality of displays, the plurality of displays including at least a distinct first display 10 and second display 20, the first display 10 including a first gear train 321 and second display 20 including a second gear train 322. Display mechanism 200 includes such a bidirectional correction mechanism 300, which is arranged to be controlled by the action of a user on a setting means, such as a control stem or suchlike, acting on a corrector pinion 310, to rotate it in one direction or another.

The invention also concerns a timepiece movement 1000 including such a display mechanism 200, and/or such a timepiece control mechanism 100. This movement 1000 includes drive means including drive wheel set 1, which is arranged to drive timepiece control mechanism 100. It also includes a winding and time-setting control stem forming a setting means, or another control means such as a pusher, pull-out piece or suchlike, able to form the setting means.

The invention further concerns a watch 2000 including such a timepiece movement 1000, and/or such a display mechanism 200, and/or such a timepiece control mechanism 100.

What is claimed is:

1. A bidirectional correction mechanism, for correcting the position of at least a first gear train and of a second gear train, and arranged to be controlled by the action of a user on a setting means, said mechanism comprising a corrector pinion, arranged to be controlled by said setting means, and including a correction lever that pivots coaxially to said corrector pinion on a main arbor comprised in said corrector pinion, and said correction lever carrying, meshing with said corrector pinion, a first intermediate wheel set arranged to drive said first gear train and a second intermediate gear train arranged to drive said second gear train, wherein said correction mechanism comprises at least one elastic element arranged, in the absence of action by a user on said setting means, to return said correction lever to a neutral position wherein said first intermediate wheel set is uncoupled from said first gear train and said second intermediate wheel set is uncoupled from said second gear train, and wherein said bidirectional correction mechanism comprises at least, either a friction connection between said correction lever and said main arbor of said corrector pinion, or a friction connection between said elastic element on the one hand, and said first intermediate wheel set and said second intermediate wheel set on the other hand, wherein said bidirectional correction mechanism includes a said friction connection between said correction lever and said main arbor of said corrector pinion, or a friction connection between said elastic element on the one hand, and on the other hand, on a first side a first arbor comprised in said first intermediate wheel set, and on a second side a second arbor comprised in said second intermediate wheel set, and wherein, when said first arbor of said first intermediate wheel set, or said second arbor of said second intermediate wheel set reaches a stop position, the corresponding friction connection slides, and said corresponding intermediate sliding gear wheel set can then rotate freely, meshing with said first gear train, respectively said second gear train.

2. The bidirectional correction mechanism according to claim 1, wherein said bidirectional correction mechanism includes a bar, comprising a first oblong hole and a second oblong hole, wherein are respectively guided a first arbor comprised in said first intermediate wheel set, and a second arbor comprised in said second intermediate wheel set, each said intermediate wheel set being in a position of engagement with said first gear train, respectively said second gear train, when said arbor thereof is stopped at the end of said oblong hole wherein said arbor moves.

3. The bidirectional correction mechanism according to claim 1, wherein said bidirectional correction mechanism comprises both a said friction connection between said correction lever and said main arbor of said corrector pinion, and a said friction connection between said elastic element, on the one hand, and said first intermediate wheel set and said second intermediate wheel set, on the other hand.

4. The bidirectional correction mechanism according to claim 1, wherein said elastic element is a spring which rests on the edges of said correction lever so as to cause friction of a first arbor comprised in said first intermediate wheel set, and of a second arbor comprised in said second intermediate wheel set, on the housings thereof in said correction lever.

5. The bidirectional correction mechanism according to claim 1, wherein said correction lever forms clamps on said main arbor, and on a first arbor comprised in said first intermediate wheel set, and on a second arbor comprised in said second intermediate wheel set, with friction jaws.

6. The bidirectional correction mechanism according to claim 1, wherein said elastic element is a spring which includes at the ends thereof blades carrying raised studs arranged to rub directly against the edges of teeth comprised in said first intermediate wheel set and said second intermediate wheel set.

7. A timepiece movement including at least a first gear train and a second gear train, and a setting means, and including a correction mechanism according to claim 1, controlled by said setting means and arranged to modify the position of said first gear train and a second gear train.

8. The timepiece movement according to claim 7, wherein said setting means is a winding and time-setting stem.

9. A watch including a timepiece movement according to claim 7.

* * * * *